US008371461B2

(12) United States Patent
Kountotsis

(10) Patent No.: US 8,371,461 B2
(45) Date of Patent: Feb. 12, 2013

(54) DUAL CHAMBERED BOTTLE WITH WEIGHT DISTRIBUTION MECHANISM AND METHOD OF MANUFACTURING THE SAME

(76) Inventor: Theodosios Kountotsis, East Elmhurst, NY (US)

( * ) Notice: Subject to any disclaimer, the term of this patent is extended or adjusted under 35 U.S.C. 154(b) by 532 days.

(21) Appl. No.: 12/583,347

(22) Filed: Aug. 19, 2009

(65) Prior Publication Data

US 2011/0042337 A1 Feb. 24, 2011

(51) Int. Cl.
*B65D 1/04* (2006.01)

(52) U.S. Cl. ..... 215/6; 220/603; 220/230

(58) Field of Classification Search ..... 220/505, 220/527, 530, 551, 603; 137/419; 92/52, 92/53; 222/134; 215/6; *B65D 1/04*
See application file for complete search history.

(56) References Cited

U.S. PATENT DOCUMENTS

| | | | | | |
|---|---|---|---|---|---|
| 3,335,912 | A | * | 8/1967 | Reeves, Jr. | 222/94 |
| 3,696,712 | A | * | 10/1972 | Sung | 92/52 |
| 3,788,520 | A | * | 1/1974 | Dukess | 222/94 |
| 4,040,420 | A | * | 8/1977 | Speer | 604/82 |
| 4,205,766 | A | * | 6/1980 | White | 222/135 |
| 4,738,660 | A | * | 4/1988 | Lucas | 604/139 |
| 4,971,211 | A | | 11/1990 | Lake | |
| 5,224,627 | A | * | 7/1993 | Weag | 222/135 |
| 5,244,120 | A | * | 9/1993 | O'Meara | 222/94 |
| 5,332,157 | A | | 7/1994 | Proctor | |
| 5,423,752 | A | * | 6/1995 | Haber et al. | 604/86 |
| D361,509 | S | | 8/1995 | Dull et al. | |
| 5,497,920 | A | | 3/1996 | Moeller et al. | |
| 5,507,156 | A | | 4/1996 | Redmon | |
| 5,597,087 | A | | 1/1997 | Vinarsky | |
| 5,667,101 | A | | 9/1997 | Barrash et al. | |
| 5,849,241 | A | * | 12/1998 | Connan | 264/529 |
| 6,010,034 | A | | 1/2000 | Walthers | |
| 6,120,202 | A | | 9/2000 | Donsky | |
| 6,135,323 | A | | 10/2000 | Chen et al. | |
| 6,464,107 | B1 | * | 10/2002 | Brugger | 222/134 |
| 6,550,647 | B1 | | 4/2003 | Kunz | |
| 6,758,411 | B2 | | 7/2004 | Conway et al. | |
| D497,104 | S | | 10/2004 | Best et al. | |
| D507,738 | S | | 7/2005 | Wagner | |
| D510,529 | S | | 10/2005 | Yates, III | |
| 7,036,684 | B1 | | 5/2006 | Hantman et al. | |
| 7,063,235 | B2 | * | 6/2006 | Auer | 222/135 |
| 7,331,478 | B2 | | 2/2008 | Aljadi | |
| 2004/0159625 | A1 | | 8/2004 | Kwon | |
| 2005/0109796 | A1 | | 5/2005 | Bourque et al. | |
| 2005/0184090 | A1 | | 8/2005 | DeJonge | |
| 2006/0021996 | A1 | | 2/2006 | Scott, III et al. | |
| 2006/0102581 | A1 | | 5/2006 | Yates, III | |
| 2008/0000866 | A1 | | 1/2008 | Yates, III | |
| 2008/0121654 | A1 | | 5/2008 | Pilowski | |
| 2008/0128378 | A1 | | 6/2008 | Nowzari | |

* cited by examiner

*Primary Examiner* — Anthony Stashick
*Assistant Examiner* — Brett Edwards
(74) *Attorney, Agent, or Firm* — Theodosios Kountotsis

(57) ABSTRACT

A bottle assembly including a body portion having a dividing wall, a first chamber for holding a first liquid and a second chamber for holding a second liquid. The base portion of the bottle assembly includes a weight distribution mechanism for counterbalancing the first liquid against the second liquid. The weight distribution mechanism is a flexible member positioned between a first base portion of the first chamber and a second base portion of the second chamber, the flexible member slidingly engaging an inner surface of the base portion of the bottle assembly. When the first liquid is reduced, the first base portion of the first chamber is displaced in a first direction and the second base portion of the second chamber is displaced in a second direction, the first direction being opposite the second direction.

11 Claims, 10 Drawing Sheets

Position 2

Position 1

Position 2

DUAL CHAMBERED BOTTLE WITH WEIGHT DISTRIBUTION MECHANISM AND METHOD OF MANUFACTURING THE SAME

CROSS REFERENCE TO RELATED APPLICATIONS

This application is related to a commonly-owned patent application having the title "Dual Chamber Bottle and Method of Manufacturing the Same," filed on Nov. 12, 2008 and assigned U.S. patent application Ser. No. 12/291,617; the entire contents of this patent application are incorporated herein by reference. This application is also related to a commonly-owned patent application having the title "Dual Chamber Bottle and Method of Manufacturing the Same," filed on Nov. 12, 2008 and assigned U.S. patent application Ser. No. 12/291,616; the entire contents of this patent application are incorporated herein by reference. This application is also related to a commonly-owned patent application having the title "Triple Chamber Bottle and Method of Manufacturing the Same," filed on Nov. 12, 2008 and assigned U.S. patent application Ser. No. 12/291,610; the entire contents of this patent application are incorporated herein by reference. This application is also related to a commonly-owned patent application having the title "Skeleton Structure Bottle with Removable Chambers and Method of Manufacturing the Same," filed on Dec. 5, 2008 and assigned U.S. patent application Ser. No. 12/315,790; the entire contents of this patent application are incorporated herein by reference. This application is also related to a commonly-owned patent application having the title "Multi-Chambered Bottles for Separating Contents and Methods of Manufacturing the Same," filed on Mar. 17, 2009 and assigned U.S. patent application Ser. No. 12/381,805; the entire contents of this patent application are incorporated herein by reference.

BACKGROUND

1. Field of the Related Art

The present disclosure relates to bottles, and more particularly, but not exclusively, to a bottle having dual chambers for separately dispensing liquids and maintaining its balance via a weight distribution mechanism.

2. Description of the Related Art

Liquid storage containers have been provided in numerous shapes and sizes for various liquid commodities. The most ubiquitous liquid storage containers are presently plastic and provide multiple shapes and sizes with mass production capability and recyclable materials. A popular liquid storage container is a drinking bottle. Typically, most individuals utilize a drinking bottle formed of a molded plastic material. The most common type of molded plastic drinking bottle employs a neck portion supporting a removable cap and a chamber connected to the neck portion. These plastic drinking bottles are reasonably durable, are reusable with most liquid drinks of choice, are economical to make and to purchase, and are easy to use.

In particular, sports bottles have become very popular over the years as molded plastic drinking bottles. Sports bottles are containers which generally have a removable lid, are relatively tall and easy to hold and have a cap or lid positioned at the top portion of the sports bottle. Sports bottles have become quite popular given the increased exercise activity of individuals. Sports bottles are convenient because they do not leak and may be readily carried or placed without fear of spilling the liquid contained therein.

One of the most critical needs facing individuals engaged in sports is the continuous supply or intake of different liquids (e.g., drinking water, sports drinks, energy drinks, protein shakes, etc.) while they exercise. During extended exercise activities, individuals face serious dehydration problems and the loss of competitive capability unless they continuously replenish the fluids lost during such exercise activities. However, the human body requires many different types of vitamins or minerals that cannot all be found in one type of liquid. Thus, once again, individuals may desire more than one type of drink to replenish body liquids lost from sweating when engaging in one or more intense workout activities, without inadvertently mixing the liquids, in order to replenish several types of vitamins and minerals. Sports enthusiasts are typically becoming more aware of the benefits of combining the use of electrolyte replacing sports drinks and/or water and/or protein shakes for ultimate performance enhancement and refreshment. Thus, there is a need to provide a sports bottle that is capable of dispensing more than one type of liquid separately, without inadvertently mixing the liquids.

Traditional sports bottles present a limitation in that they do not allow an individual to enjoy a plurality of different liquid drinks separately from each other, without mixing the liquids, and at the same time period. Presently, many dual chamber bottle systems lack the ability to effectively provide two or more liquids to an individual without mixing the liquid contents. In other words, traditional dual chamber bottles allow for inadvertent mixing of liquids, even though the individual desires to consume only one drink at a time. Thus, despite other practitioners' efforts to provide improved systems, there remains nonetheless a continuing need in the art for an improved liquid supply apparatus for use by individuals, such as, but not limited to, individuals engaged in sports or exercise activities.

The present disclosure is intended to overcome the drawbacks of conventional dual chamber bottle systems by exploiting bottle morphology in order to successfully separate liquids without allowing inadvertent mixing of liquids. It is desirable to further provide a balancing mechanism for preventing the bottle assembly from tipping over when a first liquid is consumed more often than the second liquid. It is further desirable that such a container be easily manufactured, filled, and assembled.

SUMMARY

The present disclosure provides a bottle assembly including a body portion having a dividing wall extending from a top portion to a region located above a base portion of the bottle assembly; a first chamber for holding a first liquid, the first chamber configured to connect to a first orifice; and a second chamber for holding a second liquid, the second chamber configured to connect to a second orifice; wherein the base portion of the bottle assembly includes a weight distribution mechanism for counterbalancing the first liquid against the second liquid.

The present disclosure also provides a method for manufacturing a bottle assembly, the method including the steps of forming a body portion having a dividing wall extending from a top portion to a region located above a base portion of the bottle assembly; forming a first chamber for holding a first liquid, the first chamber configured to connect to a first orifice; and forming a second chamber for holding a second liquid, the second chamber configured to connect to a second orifice; wherein the base portion of the bottle assembly includes a weight distribution mechanism for counterbalancing the first liquid against the second liquid.

The present disclosure also provides a bottle assembly including a body portion having a dividing wall extending from a top portion to a base portion of the bottle assembly; a first chamber for holding a first liquid, the first chamber configured to connect to a first orifice; and a second chamber for holding a second liquid, the second chamber configured to connect to a second orifice; wherein the base portion of the bottle assembly includes a weight distribution mechanism for balancing the first liquid against the second liquid, the weight distribution mechanism being a semi-circular buoy-like balancing configuration.

Further scope of applicability of the present disclosure will become apparent from the detailed description given hereinafter. However, it should be understood that the detailed description and specific examples, while indicating preferred embodiments of the present disclosure, are given by way of illustration only, since various changes and modifications within the spirit and scope of the present disclosure will become apparent to those skilled in the art from this detailed description.

BRIEF DESCRIPTION OF THE DRAWINGS

Various embodiments of the present disclosure will be described herein below with reference to the figures wherein.

DETAILED DESCRIPTION

Figure 1A:
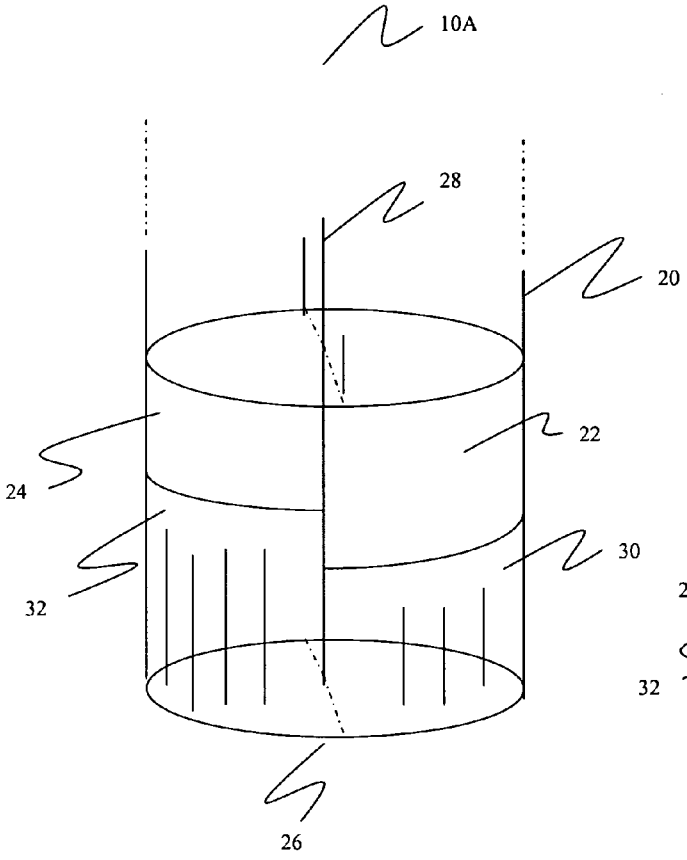
FIG. 1A is a perspective view of a portion of a dual-chambered drinking bottle having two volumetrically equal-sized chambers.

Unless otherwise indicated, all numbers expressing quantities and conditions, and so forth used in the specification and claims are to be understood as being modified in all instances by the term "about." In this application, the use of the singular includes the plural unless specifically stated otherwise. In this application, the use of "or" means "and/or" unless stated otherwise. Furthermore, the use of the term "including," as well as other forms, such as "includes" and "included," is not limiting. Also, terms such as "element" or "component" encompass both elements and components comprising one unit and elements and components that comprise more than one subunit unless specifically stated otherwise. The term "coupled to" means to be attached or connected to directly or indirectly or to be incorporated within.

As used in this description and in the appended claims, the word "container" does not necessarily refer to a rigid or a somewhat deformable structure, such as a "bottle," "bottle portion," or "bottle half" for containing liquid. Rather, the word "container" in the present disclosure and in the appended claims may also mean a "box," "packet," "bag,"

"portion of a bag," "pocket of a bag," or any such deformable structure for containing liquid. The terms "container" and "bottle" may be used interchangeably throughout the present disclosure. As used in the present disclosure and in the appended claims, the word "chamber" may refer to a cup having an open mouth for drinking or may refer to an enclosed compartment having an opening or orifice for drinking.

The present disclosure proposes to provide an improved sports bottle. It is a more particular object of the present disclosure to provide an improved sports bottle which is quickly and easily refillable with two different liquids. It is a still more particular object of the present disclosure to provide an improved sports bottle which is quickly and easily refillable and which effectively prevents the mixture of liquids when dispensed from the bottle by a user. It is a still more particular object of the present disclosure to provide an improved sports bottle that includes a weight distribution mechanism for preventing the sports bottle from tipping over when one liquid is consumed more than the other liquid or when the volumes of liquids are unequal within the sports bottle.

The present disclosure proposes to provide dual compartment pouches/chambers/channels suitable for selectively dispensing two different fluids (e.g., different beverages) from the same container. Such selective dispensing requires a chamber design that allows for manipulation of the compartments individually. This allows the consumer to selectively dispense and consume fluids separately, without the possibility of inadvertently mixing the liquids. The present disclosure also proposes a method for manufacturing a bottle having dual chambers that prevents the inadvertent mixing of liquids. Additionally, the present disclosure proposes using one or more of a plurality of weight distribution mechanisms (alone or in combination) to prevent the container from tipping over when one volume of liquid is greater than the other volume of liquid.

Reference will now be made in detail to embodiments of the present disclosure. While certain embodiments of the present disclosure will be described, it will be understood that it is not intended to limit the embodiments of the present disclosure to those described embodiments. To the contrary, reference to embodiments of the present disclosure is intended to cover alternatives, modifications, and equivalents as may be included within the spirit and scope of the embodiments of the present disclosure as defined by the appended claims.

Embodiments will be described below while referencing the accompanying figures. The accompanying figures are merely examples and are not intended to limit the scope of the present disclosure.

With reference to FIG. 1A, there is presented a portion of a dual-chambered drinking bottle having two volumetrically equal-sized chambers.

The dual chamber bottle 10A includes a body portion 20, a first chamber 22, a second chamber 24, a base portion 26, and a dividing wall 28. The first chamber 22 includes a first liquid 30 and the second chamber 24 includes a second liquid 32.

Dual chamber bottle 10A includes a body portion 20 that is preferably formed of a hollow molded plastic material that defines two substantially cylindrical liquid chambers 22, 24 and has a base portion 26. The bottle 10A includes a first chamber 22 for holding a first liquid 30 and a second chamber 24 for holding a second liquid 32, where the first liquid 30 is preferably different than the second liquid 32. It will be apparent to those skilled in the art that the diameters and/or heights of the first chamber 22 and the second chamber 24 and/or the body portion 20 may be selected in accordance with design preferences.

The dividing wall 28 extends vertically from the base portion 26, extending through the body portion 20 and ending at a gap portion forming two ridges (not shown, but explained in cross-referenced related applications) and/or ending at a connection region located above the top rim of the body portion 20. The dividing wall 28 provides a means for separating the first chamber 22 from the second chamber 24. Applying pressure to one side of the body portion 20 allows the first liquid 30 of the first chamber 22 to be forced out of the compartment and into the mouth of a user through a first orifice (described with reference to FIGS. 8A and 9A). The dividing wall 28 prevents the pressure exerted on the first chamber 22 to be transferred to the second chamber 24, thus allowing the user to selectively dispense the contents/liquids of each individual chamber/container/compartment into the mouth of a user. The operation of bottle 10A is fully described with reference to related applications cited herein in the "Cross Reference to Related Applications" section of the specification.

Figure 1B:
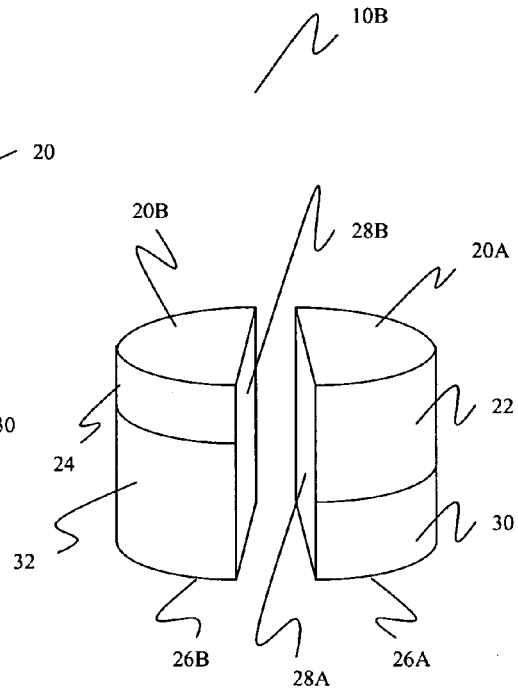
FIG. 1B is an exploded view of the portion of the dual-chambered drinking bottle having two volumetrically equal-sized chambers of FIG. 1A.

With reference to FIG. 1B, there is presented an exploded view of the portion of the dual-chambered drinking bottle having two volumetrically equal-sized chambers of FIG. 1A.

The exploded bottle 10B illustrates a first body portion 20A and a second body portion 20B. The first body portion 20A depicts the first chamber 22 having the first liquid 30. The second body portion 20B depicts the second chamber 24 having the second liquid 32. Each chamber 22, 24 includes its own base portion 26A, 26B. For instance, the first chamber 22 has a first base portion 26A and the second chamber 24 has a second base portion 26B. Additionally, the dividing wall 28 is illustrated as two portions. For instance, the first body portion 20A has a first wall portion 28A and the second body portion 20B has a second wall portion 28B. Of course, one skilled in the art may contemplate using one common wall for each chamber or attaching two chambers together, each chamber having its own wall. In other words, the bottles 10A, 10B may be assembled or manufactured by attaching or connecting or linking one or more chambered pieces/elements/components together.

Figure 2A:
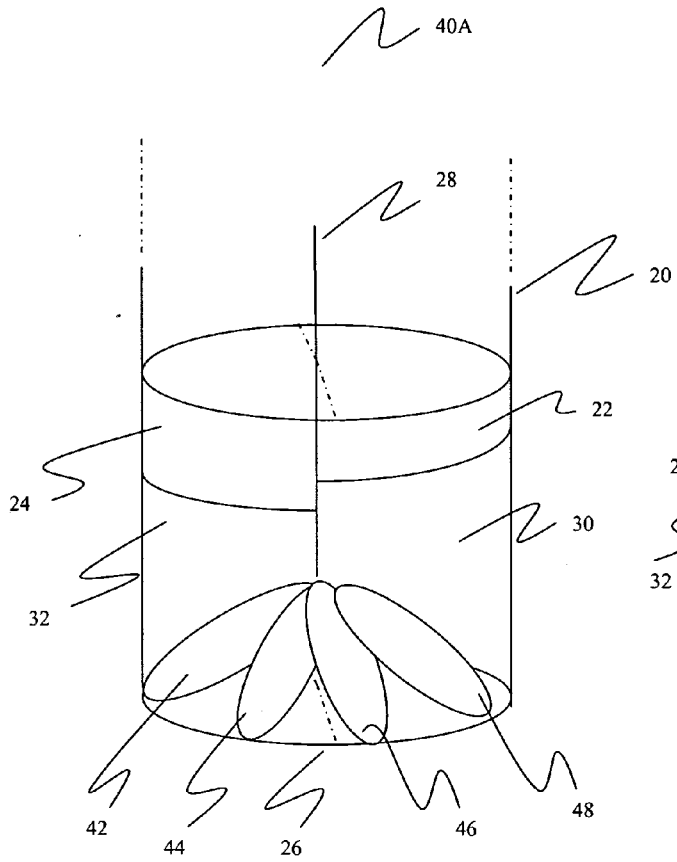
FIG. 2A is a perspective view of a dual-chambered drinking bottle having two volumetrically equal-sized chambers, with a single common base portion weight distribution mechanism, in accordance with the present disclosure.

With reference to FIG. 2A, there is presented a perspective view of a dual-chambered drinking bottle having two volumetrically equal-sized chambers, with a single common base portion weight distribution mechanism, in accordance with the present disclosure.

Figure 2B:
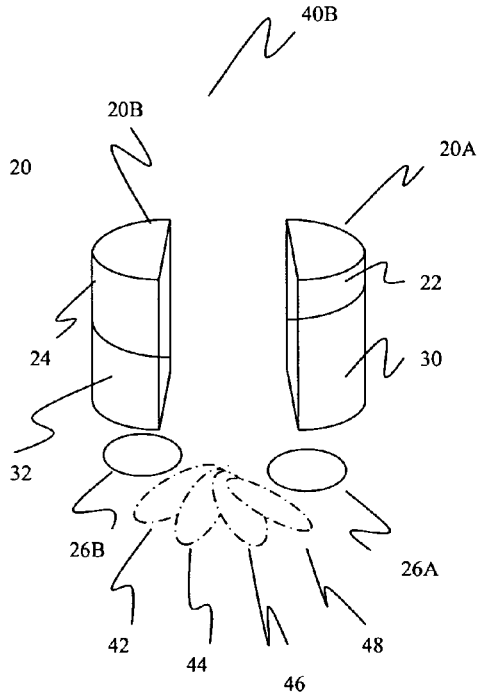
FIG. 2B is an exploded view of the weight distribution mechanism of FIG. 2A, where a common base portion of the first and second chambers acts as the weight distribution mechanism, in accordance with the present disclosure.

With reference to FIG. 2B, there is presented an exploded view of the weight distribution mechanism of FIG. 2A, where a common base portion of the first and second chambers acts as the weight distribution mechanism, in accordance with the present disclosure.

The bottle 40A includes a body portion 20, a first chamber 22, a second chamber 24, a base portion 26, and a dividing wall 28. The first chamber 22 includes a first liquid 30 and the second chamber 24 includes a second liquid 32.

FIG. 2A depicts how the two ends of the first base portion 26A and the second base portion 26B (see FIG. 2B) are one common base portion 26 that shifts or moves or is displaced or is maneuvered with respect to (or as a result of) the volumes of the liquids 30, 32 in the chambers 22, 24, respectively. In other words, one single common base portion 26 separates the first liquid 30 from the second liquid 32. FIG. 2A illustrates how the single common base portion 26 shifts between positions; for instance, a first position 42, a second position 44, a third position 46, and a fourth position 48. When the first liquid 30 is reduced, the base portion 26 shifts or changes position in accordance with the volume remaining in the first chamber 22. The first liquid 30 shifts in a first direction and the second liquid 32 shifts in a second direction, where the first direction is opposite the second direction. In other words, the first liquid 30 balances or counterbalances the second liquid 32, when one of the liquids 30, 32 is consumed by a user. Thus, the liquids 30, 32 are separated from each other by a single base portion 26.

FIG. 2B depicts an exploded view 40B of the bottle 40A. The exploded bottle 40B illustrates a first body portion 20A and a second body portion 20B. The first body portion 20A depicts the first chamber 22 having the first liquid 30. The second body portion 20B depicts the second chamber 24 having the second liquid 32.

Thus, as described above, one single base portion 26 separates the first liquid 30 from the second liquid 32. FIG. 2B illustrates how the single base portion 26 shifts between positions; for instance, a first position 42, a second position 44, a third position 46, and a fourth position 48. When the first liquid 30 is reduced, the base portion 26 shifts, slidingly engaging the bottom portion of the bottle in a U-type configuration. Once again, the first liquid 30 shifts in a first direction and the second liquid 32 shifts in a second direction, where the first direction is opposite the second direction. In other words, the first liquid 30 balances or counterbalances the second liquid 32, when one of the liquids 30, 32 is consumed by a user. Thus, the liquids 30, 32 are separated from each other by a single base portion 26.

Moreover, the bottle 40A illustrates that the chambers 22, 24 may be of different volumetric size. In other words, the first chamber 22 may be smaller than the second chamber 24 (or vice versa). The volumetric size of each chamber 22, 24 may be determined by one or more desired applications. In addition, the height of the first chamber 22 and the second chamber 24 is approximately the same in FIGS. 1A and 2A. However, the height of the first chamber 22 and the second chamber 24 may be of a different size (height, width or length). Additionally, the movable base portion 26 may be of any size, shape, or design, and may be of any desirable thickness. The movable base portion 26 may be constructed from any type of material (e.g., plastic or metal). The movable base portion 26 may also be heavier or have a greater density than the density of liquids 30, 32 so as to easily force the liquids 30, 32 to balance or counterbalance each other.

Figure 3A:
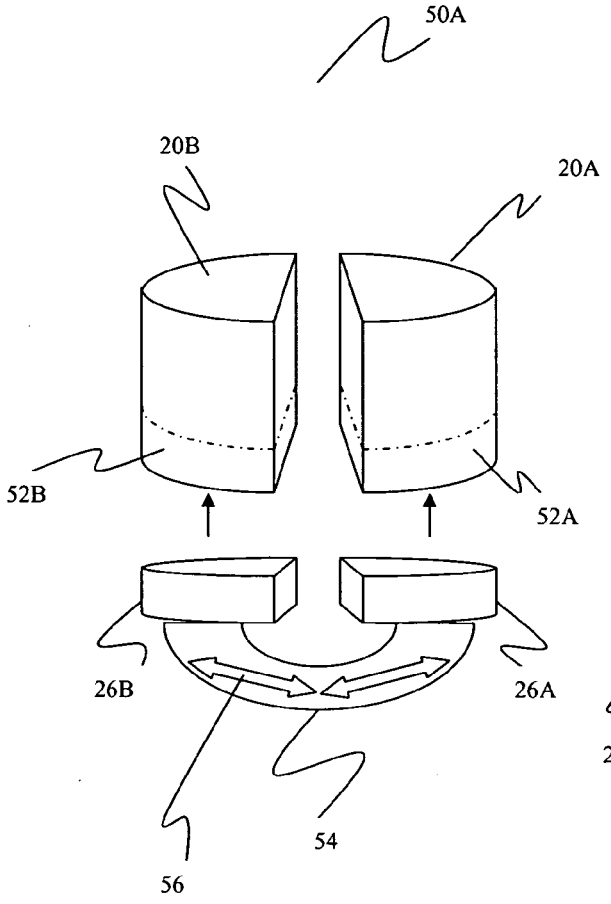
FIG. 3A is a perspective view of a first position of the dual-chambered drinking bottle having separate base portions for each of the first chamber and the second chamber, each base portion attached to a weight distribution mechanism, where the volume of the first liquid is approximately equal to the volume of the second liquid, in accordance with the present disclosure.

With reference to FIG. 3A, there is presented a perspective view of a first position of the dual-chambered drinking bottle having separate base portions for each of the first chamber and the second chamber, each base portion attached to a weight distribution mechanism, where the volume of the first liquid 30 is approximately equal to the volume of the second liquid 32, in accordance with the present disclosure.

Figure 3B:
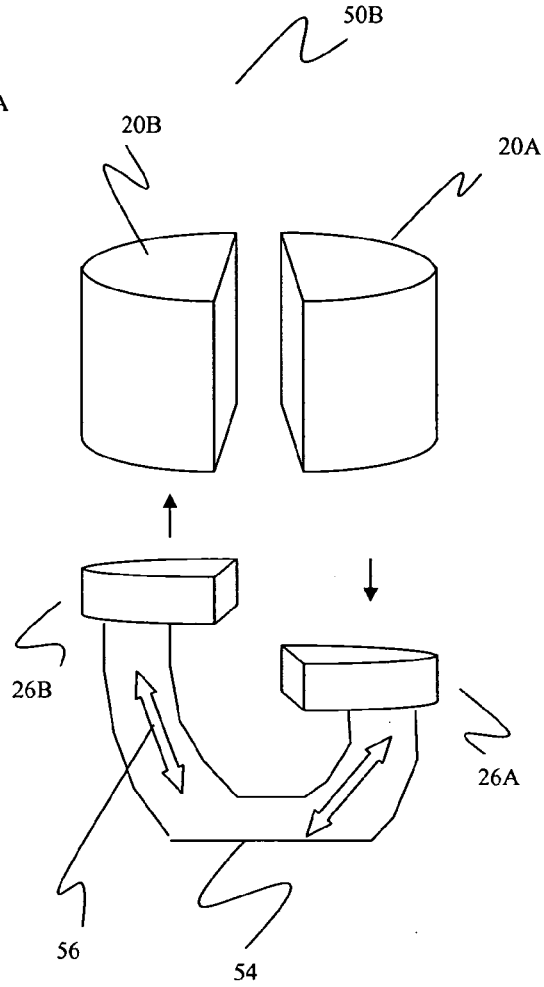
FIG. 3B is a perspective view of a second position of the dual-chambered drinking bottle having separate base portions for each of the first chamber and the second chamber, each base portion attached to a weight distribution mechanism as in FIG. 3A, where the volume of the first liquid is greater than the volume of the second liquid, in accordance with the present disclosure.

With reference to FIG. 3B, there is presented a perspective view of a second position of the dual-chambered drinking bottle having separate base portions for each of the first chamber and the second chamber, each base portion attached to a weight distribution mechanism as in FIG. 3A, where the volume of the first liquid 30 is greater than the volume of the second liquid 32, in accordance with the present disclosure.

The bottle 50A of FIG. 3A depicts a first body portion 20A having a first base insert portion 52A and a second body portion 20B having a second base insert portion 52B. The first body portion 20A may be considered a first chamber and the second body portion 20B may be considered a second chamber for simplicity. The first body portion 20A includes a first base portion 26A and the second body portion 20B includes a second base portion 26B. The first base portion 26A is connected or attached to or in cooperation with the second base portion 26B via a flexible member 54. FIG. 3A depicts arrows 56 to indicate movement of the flexible member 54 in relation to liquid volume changes in the chambers 22, 24 (language used interchangeably with first body portion 20A and second body portion 20B).

In this exemplary embodiment, the flexible member 54 is located directly between the first base portion 26A and the second base portion 26B. The bottom portion of bottles 50A and 50B merely illustrates how the base portions 26A, 26B of the chambers 22, 24 move or shift or maneuver or are displaced with respect to the volume of the first liquid 30 and the volume of the second liquid 32. The flexible member 54 is positioned between the base portions 26A, 26B to allow for the volumetric size of the chambers 22, 24, to readjust or reposition themselves as the volume of liquids 30, 32 is consumed or varied or changed or altered by a user of the bottle 50A.

The flexible member 54 is a weight distribution mechanism positioned between the first base portion 26A of the first chamber 22 and the second base portion 26B of the second chamber 24, the flexible member 54 slidingly engaging an inner surface of the base portion 26 of the bottle assembly 50A. The flexible member 54 permits the base portions 26A, 26B to be displaced with respect to each other depending on the consumption of liquids 30, 32, as illustrated in FIG. 3B. The first base portion 26A is positioned within the first chamber 22 at the first base insert portion 52A. The second base portion 26B is positioned within the second chamber 24 at the second base insert portion 52B. The insert portions 52A, 52B merely illustrate where the base portions 26A, 26B are located within the bottle 50A.

FIG. 3B demonstrates how the first base portion 26A is displaced with respect to the second base portion 26B. In this example, a user consumes the second liquid 32 located in the second chamber 24. The first liquid 30 in the first chamber 22 remains intact. As a result, the reduction of volume of the second liquid 32 causes the second base portion 26B to move/shift upwards and causes the first base portion 26A to move/shift downward. In other words, the flexible member 54 aids in the balancing or counterbalancing of liquids 30, 32 when one of the liquids 30, 32 is consumed by a user of the bottle assemblies 50A, 50B. The liquids 30, 32 balance or counterbalance each other in a continuous and automatic manner and shift or displace each other constantly as the volume of one liquid changes with respect to the volume of the other liquid within the bottle assemblies 50A, 50B. The change in volume of one liquid changes the positioning of both liquids in the bottles 50A, 50B. Therefore, there is a direct relationship between the location/position of the liquids and the volume of each liquid (changing volumes create a change in positioning).

Figure 4A:
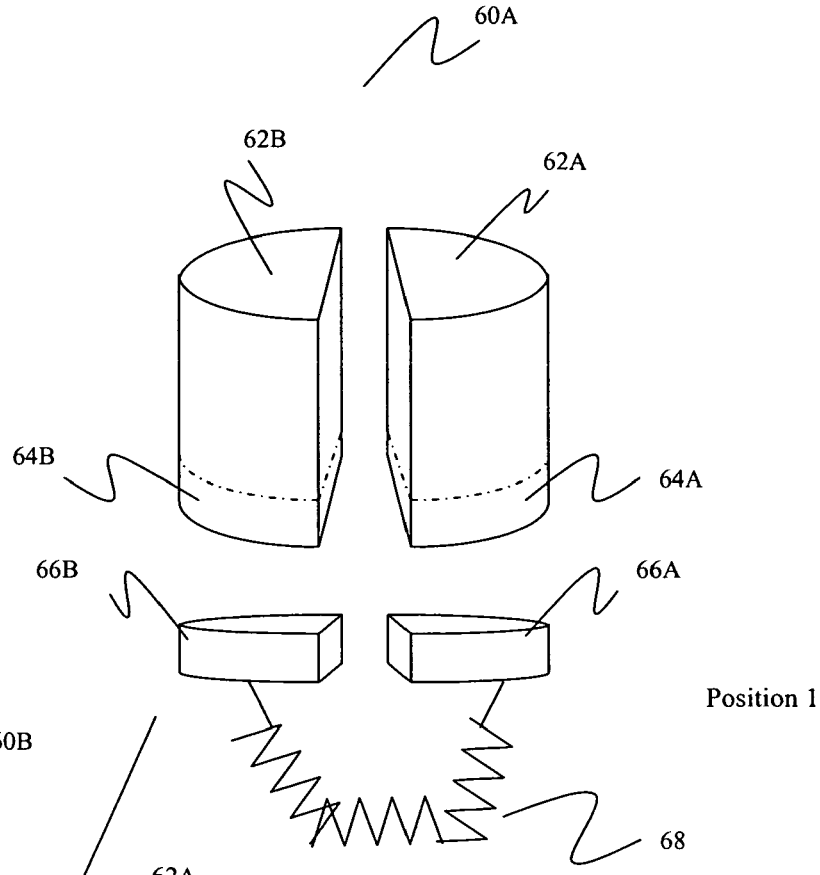
FIG. 4A is a perspective view of a first position of the dual-chambered drinking bottle having a weight distribution mechanism, the weight distribution mechanism being a spring mechanism, in accordance with the present disclosure.

With reference to FIG. 4A, there is presented a perspective view of a first position of the dual-chambered drinking bottle having a weight distribution mechanism, the weight distribution mechanism being a spring mechanism, in accordance with the present disclosure.

Figure 4B:
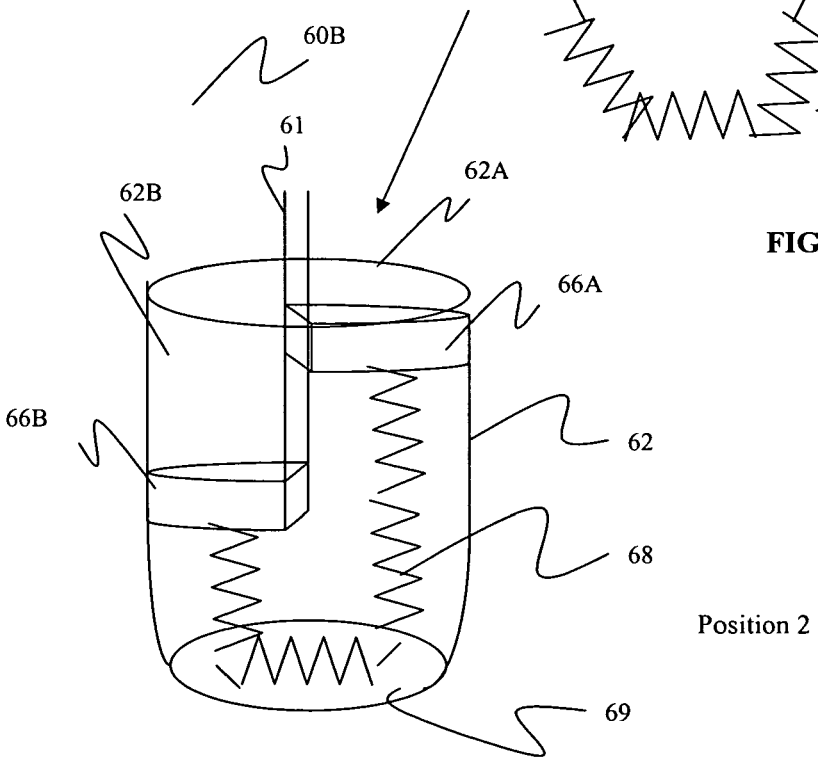
FIG. 4B is a perspective view of a second position of a dual-chambered drinking bottle having the weight distribution mechanism of FIG. 4A, the weight distribution mechanism being a spring mechanism, where the volume of the second liquid is greater than the volume of the first liquid, in accordance with the present disclosure.

With reference to FIG. 4B, there is presented a perspective view of a second position of a dual-chambered drinking bottle having the weight distribution mechanism of FIG. 4A, the weight distribution mechanism being a spring mechanism, where the volume of the second liquid 32 is greater than the volume of the first liquid 30, in accordance with the present disclosure.

The bottle 60A of FIG. 4A depicts a first body portion 62A having a first base insert portion 64A and a second body portion 62B having a second base insert portion 64B. The first body portion 62A may be considered a first chamber and the second body portion 62B may be considered a second chamber for simplicity. The first body portion 62A includes a first base portion 66A and the second body portion 62B includes a second base portion 66B. The first base portion 66A is connected or attached to or in cooperation with the second base portion 66B via a flexible member 68.

In this exemplary embodiment, the flexible member 68 is a spring mechanism. The spring mechanism may be any type of spring mechanism contemplated by one skilled in the art. The spring mechanism may be of any shape or size or of any type (e.g., compression, extension, die, torsion, tapered, disc, urethane, H-clip, or any type of custom design). Additionally, a plurality of springs may be positioned, either fully or partially, within the flexible member 68.

FIG. 4B demonstrates how the first base portion 66A is displaced with respect to the second base portion 66B. The bottle 60B includes a dividing wall 61 extending to a base portion 69 of the bottle 60B. In this example, a user consumes the first liquid 30 located in the first chamber 22. The second liquid 32 in the second chamber 24 remains intact. As a result, the reduction of volume of the first liquid 30 causes the first base portion 66A to move/shift upwards and causes the second base portion 66B to move/shift downward. In other words, the flexible member 68 aids in the balancing or counterbalancing of liquids 30, 32 when one of the liquids 30, 32 is consumed by a user of the bottle assemblies 60A, 60B. The liquids 30, 32 balance or counterbalance each other in a continuous and automatic manner and shift or displace each other constantly as the volume of one liquid changes with respect to the volume of the other liquid within the bottle assemblies 60A, 60B. The change in volume of one liquid changes the positioning of both liquids in the bottles 60A, 60B. Therefore, there is a direct relationship between the location/position of the liquids and the volume of each liquid (changing volumes create a change in positioning).

Figure 5A:
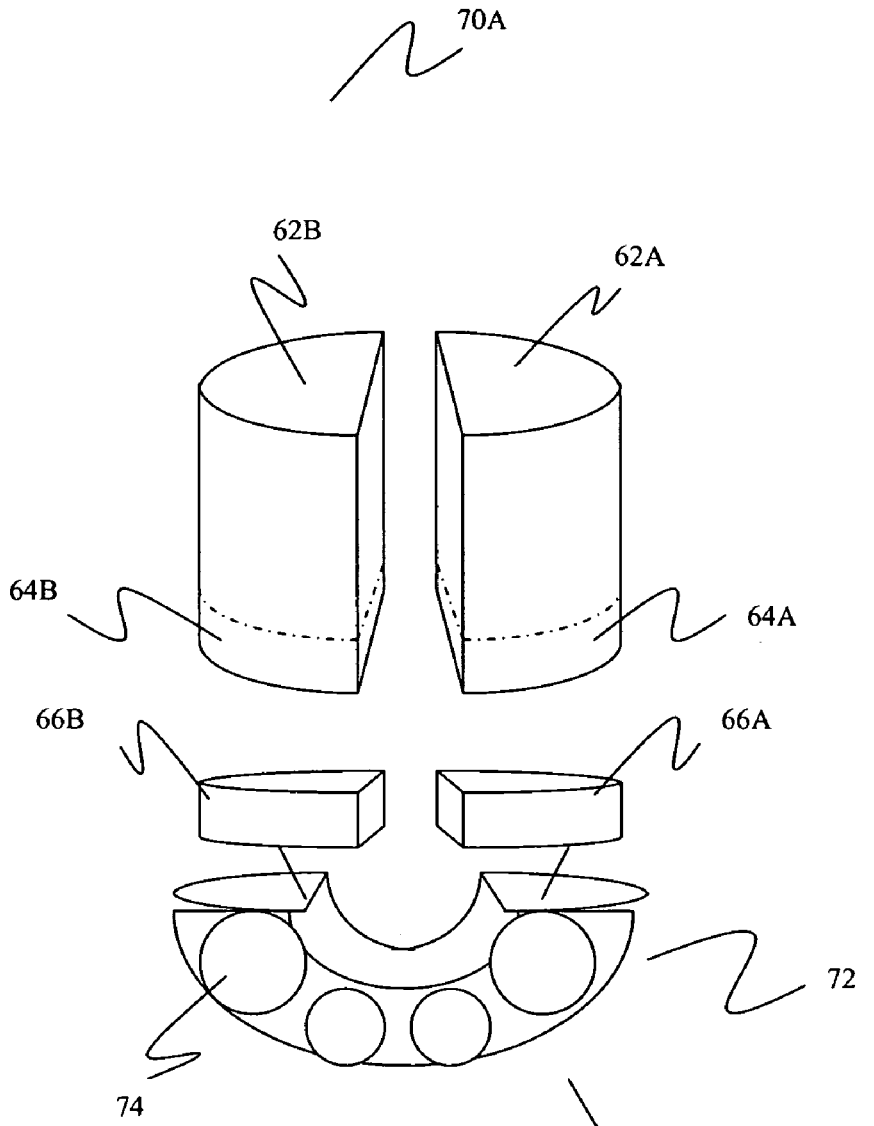
FIG. 5A is a perspective view of a dual-chambered drinking bottle having a weight distribution mechanism, the weight distribution mechanism being a single series sphere configuration, in accordance with the present disclosure.

With reference to FIG. 5A, there is presented a perspective view of a dual-chambered drinking bottle having a weight distribution mechanism, the weight distribution mechanism being a single series sphere configuration, in accordance with the present disclosure.

Figure 5B:
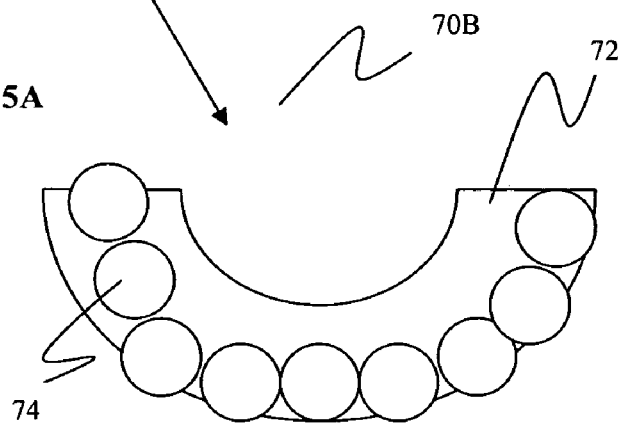
FIG. 5B is an exploded view of the single series sphere configuration of FIG. 5A, in accordance with the present disclosure.

With reference to FIG. 5B, there is presented an exploded view of the single series sphere configuration of FIG. 5A, in accordance with the present disclosure.

The bottle 70A of FIG. 5A depicts a first body portion 62A having a first base insert portion 64A and a second body portion 62B having a second base insert portion 64B. The first body portion 62A may be considered a first chamber and the second body portion 62B may be considered a second chamber for simplicity. The first body portion 62A includes a first base portion 66A and the second body portion 62B includes a second base portion 66B. The first base portion 66A is connected or attached to or in cooperation with the second base portion 66B via a flexible member 72. The flexible member 72 includes a series of spheres 74 slidingly engaging the inner surface of the flexible member 72.

In this exemplary embodiment, the flexible member 72 is a sphere mechanism. The sphere mechanism may be any type of sphere mechanism contemplated by one skilled in the art. The sphere mechanism may be any shape or size or of any type (e.g., metal, plastic, etc.) It is contemplated that the flexible member 72 includes a single series of adjacent spheres 74, where each sphere may slidingly engage the inner surface of the base portion of the bottle assembly 70A. FIG. 5B merely depicts how the single series of spheres 74, located within the flexible member 72, slidingly engage the inner surface of the base portion of the bottle assembly 70A.

Figure 6:
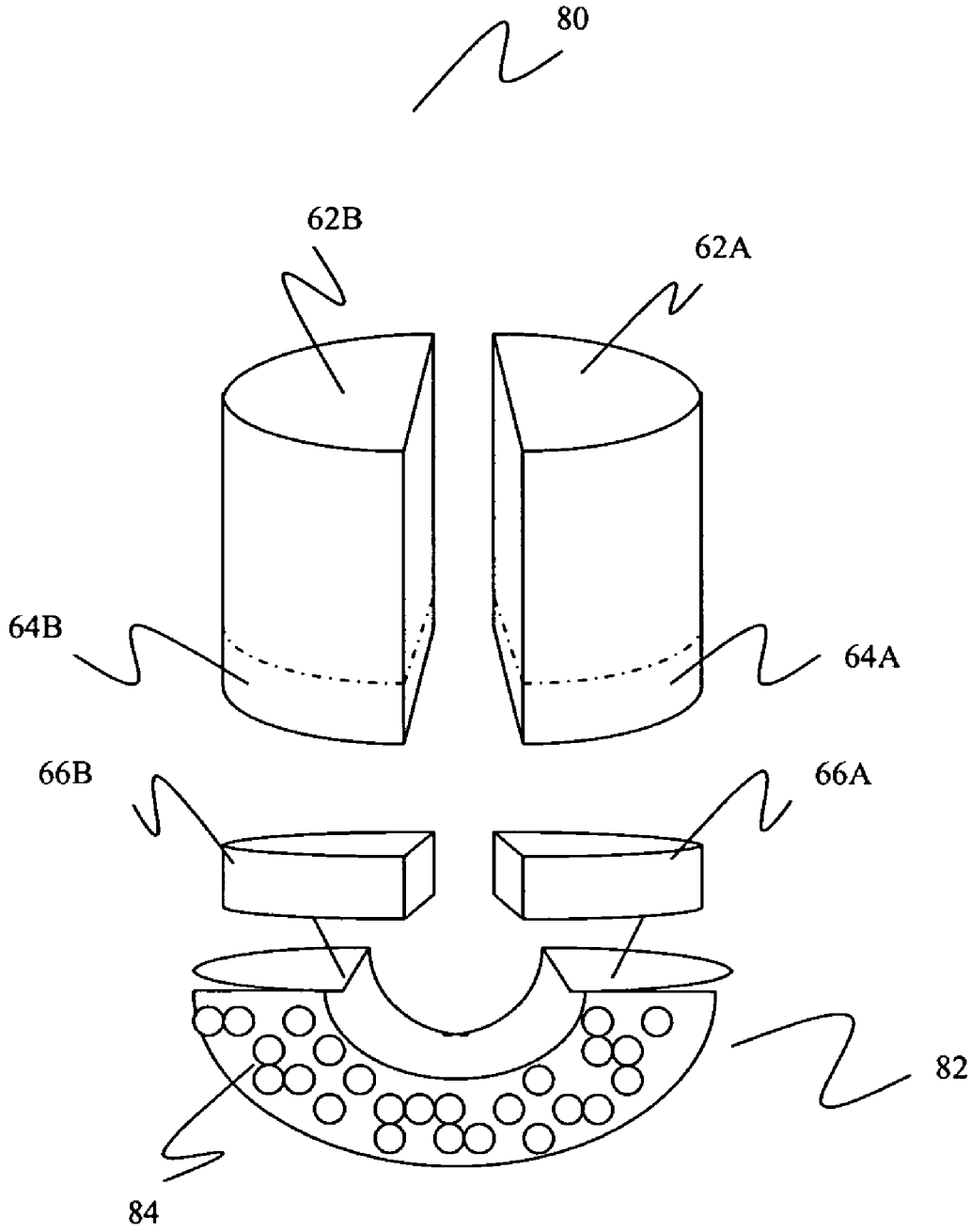
FIG. 6 is a perspective view of a dual-chambered drinking bottle having a weight distribution mechanism, the weight distribution mechanism being a plurality of spheres, in accordance with the present disclosure.

With reference to FIG. 6, there is presented a perspective view of a dual-chambered drinking bottle having a weight distribution mechanism, the weight distribution mechanism being a plurality of spheres, in accordance with the present disclosure.

The bottle 80 of FIG. 6 depicts a first body portion 62A having a first base insert portion 64A and a second body portion 62B having a second base insert portion 64B. The first body portion 62A may be considered a first chamber and the second body portion 62B may be considered a second chamber for simplicity. The first body portion 62A includes a first base portion 66A and the second body portion 62B includes a second base portion 66B. The first base portion 66A is connected or attached to or in cooperation with the second base portion 66B via a flexible member 82. The flexible member 82 includes a plurality of spheres 84, the plurality of spheres 84 being of a same or different size with respect to each other.

In this exemplary embodiment, the flexible member 82 is a sphere mechanism having a plurality of spheres of different shapes and sizes in a random, non-linear configuration 84. The plurality of spheres 84 may be any type of sphere mechanism contemplated by one skilled in the art. The plurality of spheres 84 may be any shape or size or of any type (e.g., metal, plastic, etc.). The plurality of spheres 84 need not slidingly engage the inner surface of the flexible member 82.

Figure 7A:
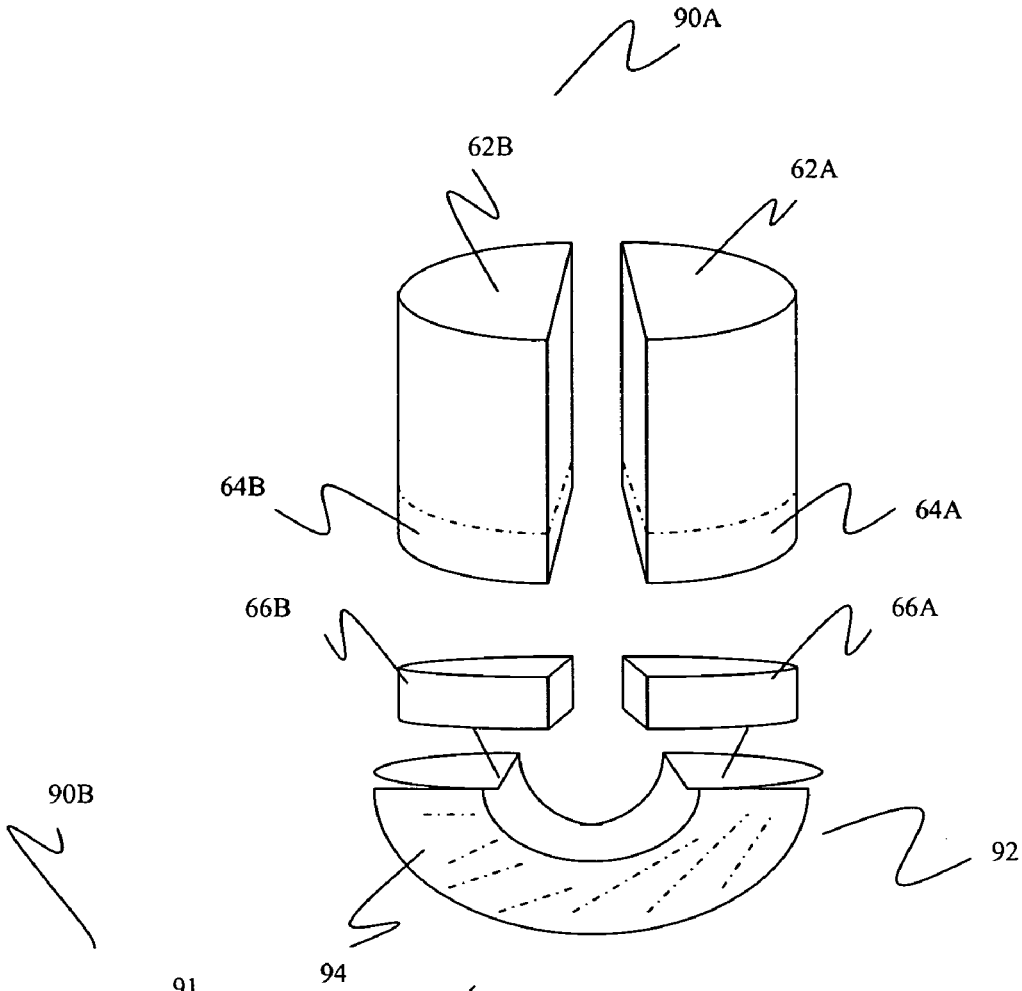
FIG. 7A is a perspective view of a first position of a dual-chambered drinking bottle having a weight distribution mechanism, the weight distribution mechanism being a liquid or gel-like configuration, in accordance with the present disclosure.

With reference to FIG. 7A, there is presented a perspective view of a first position of a dual-chambered drinking bottle having a weight distribution mechanism, the weight distribution mechanism being a liquid or gel-like configuration, in accordance with the present disclosure.

Figure 7B:
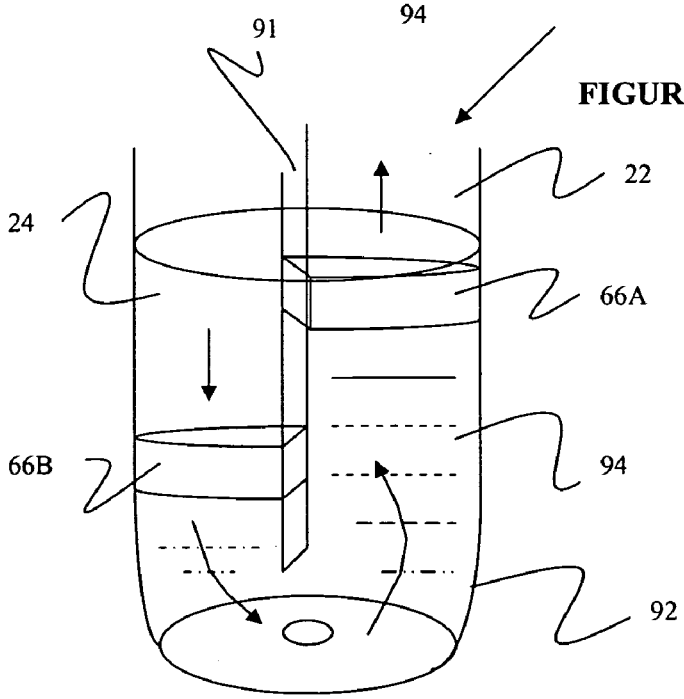
FIG. 7B is a perspective view of a second position of a dual-chambered drinking bottle having the weight distribution mechanism of FIG. 7A, the weight distribution mechanism being a liquid or gel-like mechanism, where the volume of the second liquid is greater than the volume of the first liquid, in accordance with the present disclosure.

With reference to FIG. 7B, there is presented a perspective view of a second position of a dual-chambered drinking bottle having the weight distribution mechanism of FIG. 7A, the weight distribution mechanism being a liquid or gel-like mechanism, where the volume of the second liquid 32 is greater than the volume of the first liquid 30, in accordance with the present disclosure.

The bottle 90A of FIG. 7A depicts a first body portion 62A having a first base insert portion 64A and a second body portion 62B having a second base insert portion 64B. The first body portion 62A may be considered a first chamber and the second body portion 62B may be considered a second chamber for simplicity. The first body portion 62A includes a first base portion 66A and the second body portion 62B includes a second base portion 66B. The first base portion 66A is connected or attached to or in cooperation with the second base portion 66B via a flexible member 92. The flexible member 92 includes a liquid 94 or a gel-like material 94. The liquid 94 or gel-like material 94 may be of a different density than the density of the liquids 30, 32.

In this exemplary embodiment, the flexible member 92 is or contains or incorporates a liquid or a gel-like material 94. The fluid or gel 94 may be any type of fluid, liquid, or gel contemplated by one skilled in the art. Additionally, a plurality of different fluids 94 may be positioned, either fully or partially, within the flexible member 92. In other words, the flexible member 92 may contain one fluid, two different fluids, or a plurality of different fluids in different patterns (e.g., linear, zigzag, layered, checkered, etc.). Fluids and gel-like materials 94 may be mixed within the flexible member 92. In other words, a fluid 94 may be sandwiched between a gel-like material or a gel-like material may be sandwiched between a fluid 94. One skilled in the art may contemplate a plurality of different combinations of materials/fluids/devices to act as a balancing or counterbalancing weight distribution mechanisms/configurations. Moreover, it is contemplated that one skilled in the art may envision a flexible member 92 having, including, incorporating, being assembled with or being in association with one or more spring, sphere, liquid, and/or gel combinations depending on the desired application.

FIG. 7B demonstrates how the first base portion 66A is displaced with respect to the second base portion 66B. The bottle 90B includes a dividing wall 91 extending to a base portion 92 of the bottle 90B. In this example, a user consumes the first liquid 30 located in the first chamber 22. The second liquid 32 in the second chamber 24 remains intact. As a result, the reduction of volume of the first liquid 30 causes the first base portion 66A to move/shift upwards and causes the second base portion 66B to move/shift downward. In other words, the flexible member 92 aids in the balancing or counterbalancing of liquids 30, 32 when one of the liquids 30, 32 is consumed by a user of the bottle assemblies 90A, 90B. The liquids 30, 32 balance or counterbalance each other in a continuous and automatic manner and shift or displace each other constantly as the volume of one liquid changes with respect to the volume of the other liquid within the bottle assemblies 90A, 90B. The change in volume of one liquid changes the positioning of both liquids in the bottles 90A, 90B. Therefore, there is a direct relationship between the location/position of the liquids and the volume of each liquid (changing volumes create a change in positioning).

Figure 8A:
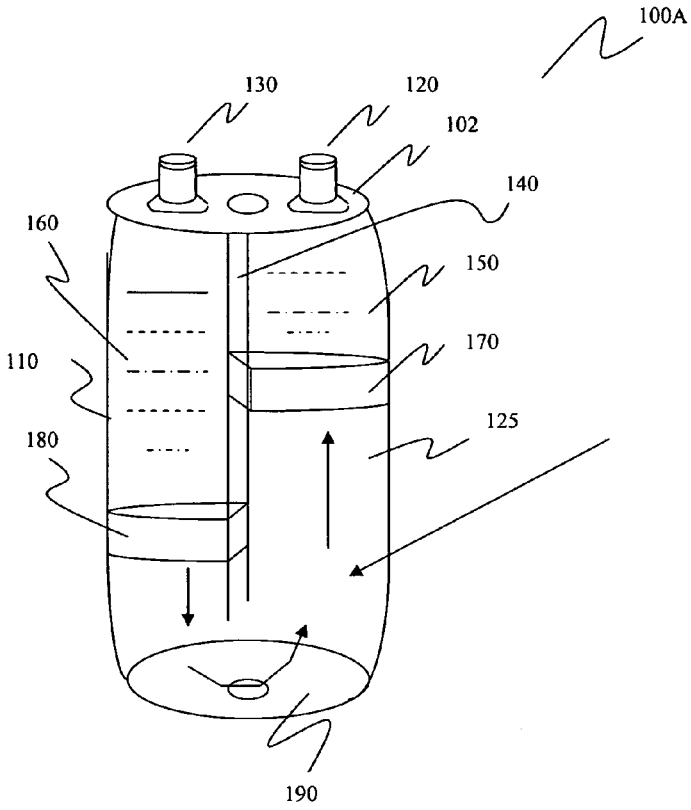
FIG. 8A is a perspective view of a full dual-chambered drinking bottle having two orifices, having a weight distribution mechanism for counterbalancing the first liquid against the second liquid, wherein when the first liquid is reduced, the first base portion of the first chamber shifts in a first direction and the second base portion of the second chamber shifts in a second direction, the first direction being opposite the second direction, in accordance with the present disclosure.

With reference to FIG. 8A, there is presented a perspective view of a full dual-chambered drinking bottle having two orifices, having a weight distribution mechanism for counterbalancing the first liquid against the second liquid, wherein when the first liquid is reduced, the first base portion of the first chamber shifts in a first direction and the second base portion of the second chamber shifts in a second direction, the first direction being opposite the second direction, in accordance with the present disclosure.

Figure 8B:
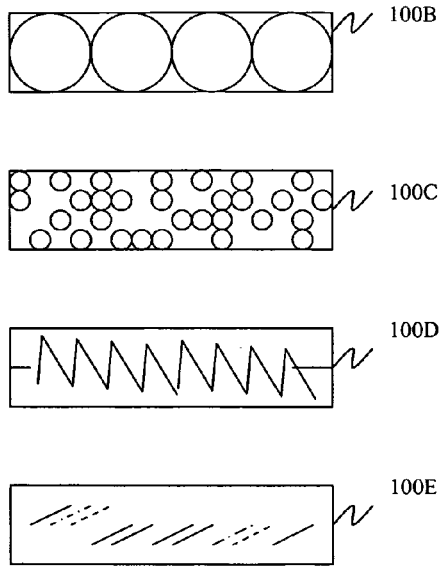
FIG. 8B is an exploded view of several of the weight distribution mechanisms of FIGS. 4A, 5A, 6, and 7, in accordance with the present disclosure.

With reference to FIG. 8B, there is presented an exploded view of several of the weight distribution mechanisms of FIGS. 4A, 5A, 6, and 7, in accordance with the present disclosure.

The bottle 100A of FIG. 8A includes a body portion 110, a first orifice 120, a second orifice 130, a dividing wall 140, a first liquid 150, a second liquid 160, a first base portion 170, a second base portion 180, and a bottle base portion 190. The first orifice 120 and the second orifice 130 are positioned on a top portion 102.

FIG. 8A merely illustrates a full bottle configuration. The flexible member 125 may be any type of flexible member described herein. As shown in FIG. 8B the flexible member 125 may be a single series of spheres 100B or a plurality of random spheres 100C or a spring mechanism 100D or a liquid/gel structure 100E. All these structures have been fully described above. Of course, any combination of these structures may be utilized to create a weight distribution mechanism, partially or fully embedded within a flexible member.

In addition, the first orifice 120 may be a different design than the second orifice 130. For example, the first orifice 120 may be a straw configuration, whereas the second orifice 130 may be a cap configuration. Of course, one skilled in the art may contemplate any combination of different types of orifices that are reasonable and/or suitable to such bottle 100A.

Figure 9A:
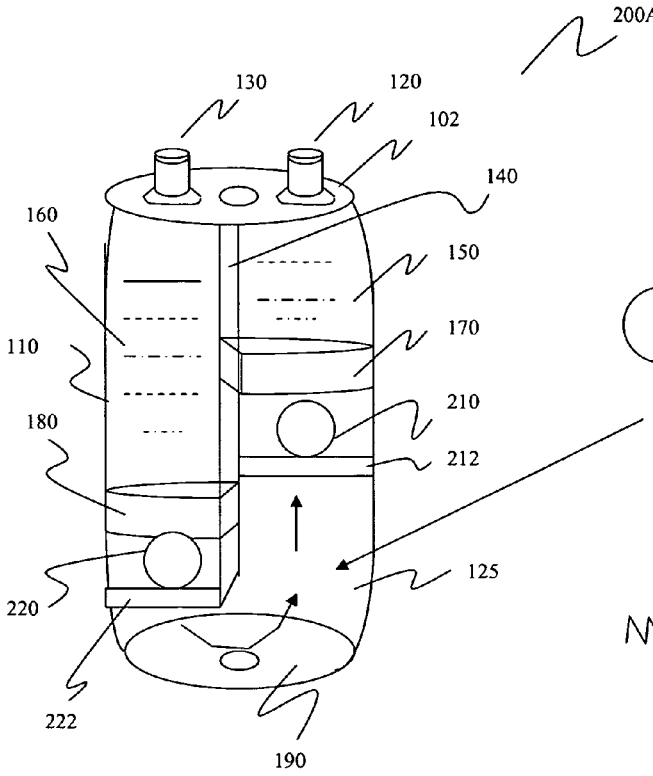
FIG. 9A is a perspective view of a second embodiment of the present disclosure illustrating a dual-chambered drinking bottle having a weight distribution mechanism, the weight distribution mechanism having two spheres at the ends of the flexible member, in accordance with the second embodiment of the present disclosure.

With reference to FIG. 9A, there is presented a perspective view of a second embodiment of the present disclosure illustrating a dual-chambered drinking bottle having a weight distribution mechanism, the weight distribution mechanism having two spheres at the ends of the flexible member, in accordance with the second embodiment of the present disclosure.

Figure 9B:
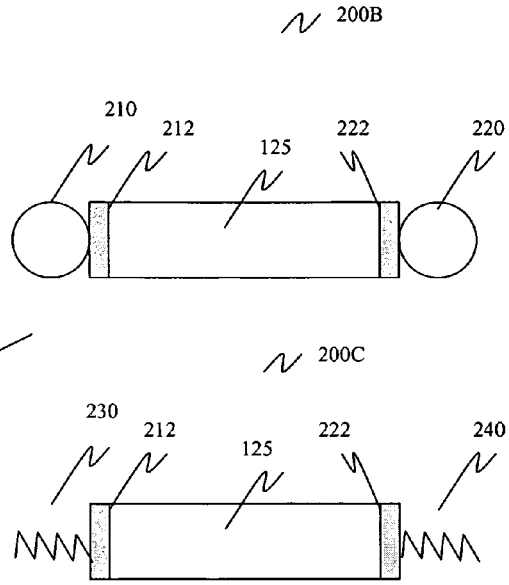
FIG. 9B is an exploded view of at least two different weight distribution mechanisms of FIG. 9A, in accordance with the second embodiment of the present disclosure.

With reference to FIG. 9B, there is presented an exploded view of at least two different weight distribution mechanisms of FIG. 9A, in accordance with the second embodiment of the present disclosure.

In the second exemplary embodiment of the present disclosure, the flexible member is modified to include exterior components attached to the flexible member.

The bottle 200A of FIG. 9A includes a body portion 110, a first orifice 120, a second orifice 130, a dividing wall 140, a first liquid 150, a second liquid 160, a first base portion 170, a second base portion 180, and a bottle base portion 190. The first orifice 120 and the second orifice 130 are positioned on a top portion 102. The flexible member 125 includes a first end 212 and a second end 222. The first end 212 includes a first sphere 210 and the second end 222 includes a second sphere 220.

As shown in FIG. 9B, the flexible member 200B is composed of three components. The flexible member 200B includes a first sphere 210 connected to a first end 212 of the flexible member 125 and a second sphere 220 connected to a second end 222 of the flexible member 125. It is noted that the spheres 210, 220 need not be "connected" to the flexible member 125. For example, the spheres 210, 220 may be located adjacent to the flexible member 125 in a disconnected or disassembled manner. Additionally, spheres 210, 220 need not be used in conjunction with the flexible member 125. As shown in 200C, a pair of springs 230, 240 may be attached on opposing ends of the flexible member 125. In fact, it is contemplated that one skilled in the art may use a plurality of different elements or components on opposing ends of the flexible member 125 to create a balancing or counterbalancing effect of the liquids 30, 32.

Figure 10:
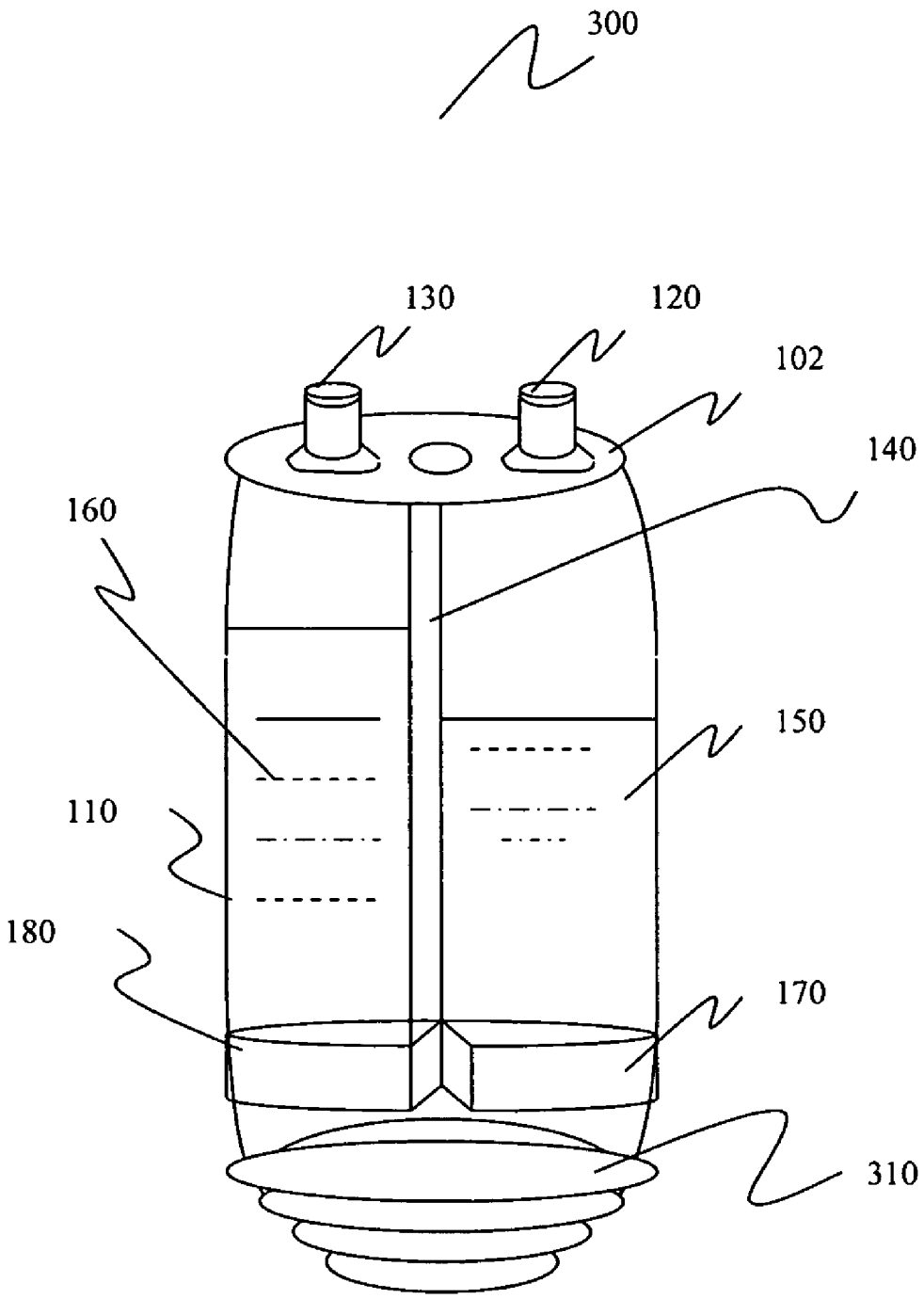
FIG. 10 is a perspective view of a third embodiment of the present disclosure illustrating a dual-chambered drinking bottle having a weight distribution mechanism, the weight distribution mechanism being a semi-circular buoy-like balancing mechanism, in accordance with a third embodiment of the present disclosure.

With reference to FIG. 10, there is presented a perspective view of a third embodiment of the present disclosure illustrating a dual-chambered drinking bottle having a weight distribution mechanism, the weight distribution mechanism being a semi-circular buoy-like balancing mechanism, in accordance with a third embodiment of the present disclosure.

In the third exemplary embodiment of the present disclosure, the flexible member is modified to be a buoy-like structure positioned at the bottom surface of the bottle 300. In other words, this is a buoy bottle.

The bottle 300 of FIG. 10 includes a body portion 110, a first orifice 120, a second orifice 130, a dividing wall 140, a first liquid 150, a second liquid 160, a first base portion 170, a second base portion 180, and a balancing structure 310. The first orifice 120 and the second orifice 130 are positioned on a top portion 102.

The balancing structure 310 preferably weighs more than the body 110 of the bottle 300. The balancing structure 310 preferably is a semi-circular shape that allows the bottle 300 to sway as liquids 30, 32 are consumed by a user. In other words, the balancing structure 310 maintains the bottle 300 in an upright position, thus preventing the bottle 300 from tipping over, when an unequal amount of liquid is present in the chambers 22, 24. As shown in FIG. 10, the base portions 170, 180 need not be shifted in any direction with respect to the amount of liquid in the chambers 22, 24 (counteracting/counterbalancing effect). The balancing structure 310 may be any shape or size or pattern or design, and may be located directly underneath the base portion of the bottle 300 or may envelop a lower portion of the bottle 300.

The balancing structure 310 may include a number of materials within it to balance the bottle 300. For example, the balancing structure 310 may include a liquid of different density than the liquids 30, 32 or it may include a gel-like material. Of course, the balancing structure 310 may be hollow and merely have a metal skeleton structure that weighs more than the bottle 300.

The balancing structure 310 may be snap-fitted onto the bottle 300 or may be twisted onto the bottom portion of the bottle 300. Of course, one skilled in the art may envision a plurality of attachment mechanisms for linking the two elements/components together in a securedly fixed manner.

Furthermore, there are certain challenges that have developed in the use of sport bottles. For example, sport bottles are typically being utilized in an outdoor environment, which makes it very difficult to keep the contents cool. In most cases the sports bottle sits out in the sun or the hot air and rapidly loses the chilling effect of the liquid, with the result that an individual then have a warm liquid. This is highly undesirable as cool liquids are significantly more refreshing. In addition, with indoor health clubs/gyms being at room temperatures and warmer than preferred for a refreshing drink, many individuals may add ice to the drink to maintain it cooler. However, this may require time and effort in fitting the ice cubes individually into the bottle fill opening, and moreover dilutes all drinks other than water as the ice melts.

It is contemplated to use, in the exemplary embodiments of the present disclosure, a single cooling element positioned at the base portion of all the exemplary bottles. The cooling element may be positioned in a separate compartment located at the bottom of both the first chamber and the second chamber in order to cool both liquids at the same time. It is noted that the cooling element may be a removable cooling element that may be replaced at any time by the user of the bottle. The cooling element may be any type of cooling element contemplated by one skilled in the art.

It is contemplated to use, in the exemplary embodiments of the present disclosure, two cooling elements, a first cooling element and a second cooling element positioned at the base portion of the all the exemplary bottles. The first cooling element and the second cooling element may be positioned in a separate compartment (single compartment or dual compartment) located at the bottom of the first chamber and the second chamber, respectively, in order to cool the first liquid with the first cooling element and to cool the second liquid with the second cooling element. In other words, each chamber may include its own separate cooling element for cooling each liquid. It is noted that the cooling elements may be removable cooling elements that may be replaced at any time by the user of the bottle. The cooling elements may be any type of cooling elements contemplated by one skilled in the art.

Moreover, while threaded connections may be utilized to connect various components in the described embodiments, many other forms of connections, such as snap together connections, twist-to-lock connections and the like also may be utilized. The present disclosure may also include a twist-on or snap-on spout or nozzle, preferably of a tapered conical or substantially cylindrical shape, and internally divided. The spout or nozzle may be adapted to be sealed by an end cap, a plug, by helically twisting the "overcap" upon a "scaling rod," or by sliding upon an internal shaft affecting a seal when screwed or pushed downwards towards the bottle.

Optionally, the body of all bottles of the present disclosure may be constructed of a clear or transparent or translucent material in order to better identify the liquid contained within the first chamber and the second chamber.

Additionally, all the bottles of the present disclosure are not limited to any particular bottle shape or design. Although the bottles are described and depicted herein as being of generally cylindrical upstanding form, the configurations of the containers is a matter of design choice. The use of generally cylindrical containers is described because it gives the sports bottle a readily acceptable appearance and shape, and because generally cylindrical container shapes tend to work well if one also desires to make use of generally cylindrical, externally threaded container necks. Moreover, generally cylindrical containers tend to efficiently provide good fluid-carrying capacity at relatively low manufacturing cost. While opaque, single-thickness materials may be preferred for use, transparent or plural-layer materials may be used, if desired, to enhance visibility, to provide added insulating capability, or for other purposes.

Moreover, the first chamber and the second chamber of all the bottles of the present disclosure may be designed to contain different ratios of liquids. For example, a 50/50 ratio between the first chamber and the second chamber may be preferred. However, it is envisioned that even a 1/3 to 2/3 ratio may be practical for certain applications.

Furthermore, all the bottles of the present disclosure may include one or more caps or lids, and each of the one or more caps or lids may have a strap connected to the body. All the bottles of the present disclosure may include one or more cooling elements to cool the liquids contained within the chambers or containers. All the bottles of the present disclosure may include one or more collapsible portions (partial or full) to bend the chamber or containers. All the bottles of the present disclosure may be of different widths and/or heights, and each chamber of all the bottles may be of a different width and/or height. All the bottles of the present disclosure may have different caps of different shapes and/or sizes with a plurality of fastening means. All the bottles of the present disclosure may include slidable orifices moving on a slidable track in a variety of tracks. All the bottles of the present disclosure may have interchangeable parts.

Finally, all the bottles of the present disclosure may be constructed by any manufacturing means. For example, blow molding technology may be utilized. A plurality of different types of thermoplastic resins may be utilized in any type of blow molding techniques.

Accordingly, the present disclosure prevents the mixing of contents of multiple chambers during the dispensing process, thus minimizing or even eliminating the risk that two liquids are simultaneously dispensed in an inadvertent manner. Additionally, the present disclosure provides for a weight distribution mechanism that prevents the bottle from tipping over when one fluid is reduced with respect to the other liquid (e.g., due to consumption of one liquid more than the other liquid). In other words, unequal amounts of liquid in each chamber do not cause the bottles to tip over due to uneven weight distribution. The weight distribution mechanism resolves uneven liquid weight within one or more chambers of a bottle.

It will be understood that there are to be no limitations as to the dimensions and shape of the beverage bottle, including the storage compartment, or the materials from which the beverage bottle is manufactured. The bottles may be constructed to resemble any commercially available bottle for holding a liquid beverage and may be manufactured from any suitable plastic, glass or metal material. Furthermore, it should be understood that the beverage bottle of the present disclosure may be adapted to store any suitable liquid, such as, for example, water, juice, milk, carbonated sodas, protein shakes, energy drinks, beer, wine, and liquor.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

Having described the invention above, various modifications of the techniques, procedures, material and equipment will be apparent to those in the art. It is intended that all such variations within the scope and spirit of the appended claims be embraced thereby.

The foregoing examples illustrate various aspects of the present disclosure and practice of the methods of the present disclosure. The examples are not intended to provide an exhaustive description of the many different embodiments of the present disclosure. Thus, although the foregoing disclosure has been described in some detail by way of illustration and example for purposes of clarity and understanding, those of ordinary skill in the art will realize readily that many changes and modifications may be made thereto without departing form the spirit or scope of the present disclosure.

What is claimed is:

1. A bottle assembly, comprising:

a body portion having a single dividing wall extending therein from a top portion to a region located above a base portion of the bottle assembly;

a first chamber for holding a first liquid, the first chamber configured to connect to a first orifice;

a second chamber for holding a second liquid, the second chamber configured to (i) connect to a second orifice and (ii) continuously abut the first chamber via the single dividing wall being fixed relative to the first and second chambers, the single dividing wall separating the first chamber from the second chamber by extending between the first and second chambers; and a weight distribution mechanism configured to be placed entirely within the body portion of the bottle for counterbalancing the first liquid against the second liquid, the weight distribution mechanism traveling, in its entirety, in a substantially semi-circular direction.

2. The bottle assembly according to claim 1, wherein the weight distribution mechanism includes a substantially U-shaped flexible member positioned between a first base portion of the first chamber and a second base portion of the second chamber, the flexible member slidingly engaging an inner surface of the base portion of the bottle assembly.

3. The bottle assembly according to claim 2, wherein when the first liquid is reduced, the first base portion of the first chamber automatically shifts in a first direction and the second base portion of the second chamber automatically shifts in a second direction, the first direction being opposite the second direction.

4. The bottle assembly according to claim 2, wherein the flexible member encompasses a spring mechanism.

5. The bottle assembly according to claim 2, wherein the first base portion is displaced based on a change in volume of either the first or second liquids.

6. The bottle assembly according to claim 2, wherein the second base portion is displaced based on a change in volume of either the first or second liquids.

7. The bottle assembly according to claim 2, wherein the flexible member automatically moves without a manual force applied thereto.

8. The bottle assembly according to claim 2, wherein the flexible member expands and contracts in accordance with volume changes within the first and second chambers.

9. The bottle assembly according to claim 1, wherein a direct relationship is established between volumes of first and second liquids, and positioning of the first and second base portions.

10. The bottle assembly according to claim 1, wherein the first and second chambers are configured to have a same volumetric size and a same height.

11. The bottle assembly according to claim 1, wherein the first and second chambers are dimensioned and adapted to prevent mixture of the first and second liquids during storage and during dispensement of the first and second liquids.

* * * * *